US008890718B2

(12) United States Patent
Block

(10) Patent No.: US 8,890,718 B2
(45) Date of Patent: Nov. 18, 2014

(54) TAWS WITH ALERT SUPPRESSION

(75) Inventor: Gerald J. Block, Vista, CA (US)

(73) Assignee: Sandel Avionics, Inc., Vista, CA (US)

( * ) Notice: Subject to any disclaimer, the term of this patent is extended or adjusted under 35 U.S.C. 154(b) by 363 days.

(21) Appl. No.: 13/083,115

(22) Filed: Apr. 8, 2011

(65) Prior Publication Data

US 2011/0276201 A1 Nov. 10, 2011

Related U.S. Application Data

(60) Provisional application No. 61/322,522, filed on Apr. 9, 2010.

(51) Int. Cl.

| | |
|---|---|
| ***G08G 5/00*** | (2006.01) |
| ***G08G 5/02*** | (2006.01) |
| *G08G 5/04* | (2006.01) |

(52) U.S. Cl.

CPC ..... *G08G 5/0086* (2013.01); *G08G 5/04* (2013.01); *G08G 5/025* (2013.01)

USPC ..... 340/945; 701/16; 701/301; 701/467; 340/947; 340/948; 340/951; 340/963

(58) Field of Classification Search

None

See application file for complete search history.

(56) References Cited

U.S. PATENT DOCUMENTS

| | | | | |
|---|---|---|---|---|
| 3,631,476 | A | 12/1971 | Schaffer | |
| 3,643,258 | A | 2/1972 | Balding | |
| 3,907,223 | A | 9/1975 | Crane | |
| 4,593,285 | A | 6/1986 | Miller et al. | |
| 5,057,835 | A | 10/1991 | Factor et al. | |
| 5,119,091 | A | 6/1992 | Zweifel | |
| 5,196,847 | A | 3/1993 | Bateman | |
| 5,467,085 | A | 11/1995 | Dunn | |
| 5,475,594 | A | 12/1995 | Oder et al. | |
| 5,521,658 | A | 5/1996 | Donohoe | |
| 5,543,870 | A | 8/1996 | Blanchard | |
| 5,561,854 | A | 10/1996 | Antic et al. | |
| 5,594,942 | A | 1/1997 | Antic et al. | |
| 5,651,676 | A | 7/1997 | Artwick | |
| 5,677,842 | A | 10/1997 | Denoize et al. | |
| 5,726,719 | A | 3/1998 | Tanaka et al. | |
| 5,839,080 | A * | 11/1998 | Muller et al. | 701/9 |
| 5,999,924 | A | 12/1999 | Bair et al. | |
| 6,092,009 | A | 7/2000 | Glover | |
| 6,122,570 | A | 9/2000 | Muller et al. | |
| 6,138,060 | A | 10/2000 | Conner et al. | |
| 6,148,308 | A | 11/2000 | Neubauer et al. | |
| 6,219,592 | B1 | 4/2001 | Muller et al. | |
| 6,259,378 | B1 | 7/2001 | Block | |
| 6,304,800 | B1 * | 10/2001 | Ishihara et al. | 701/16 |
| 6,317,663 | B1 * | 11/2001 | Meunier et al. | 701/16 |
| 6,567,728 | B1 * | 5/2003 | Kelly et al. | 701/9 |
| 6,591,170 | B2 | 7/2003 | Block et al. | |
| 6,678,588 | B2 * | 1/2004 | He | 701/3 |
| 6,980,892 | B1 * | 12/2005 | Chen et al. | 701/9 |
| 7,363,121 | B1 * | 4/2008 | Chen et al. | 701/9 |
| 7,382,287 | B1 * | 6/2008 | Chen et al. | 340/972 |

(Continued)

*Primary Examiner* — Thomas Tarcza
*Assistant Examiner* — Richard Goldman
(74) *Attorney, Agent, or Firm* — Mark D. Wieczorek; Mayer & Williams PC

(57) ABSTRACT

An aircraft terrain awareness warning system is disclosed that includes an interface for entering flight plan details of an aircraft including at least one waypoint. The terrain awareness warning system is configured such that potential-terrain-collision alerts are suppressed in the aircraft during landing operations performed at waypoints associated with landing zones.

21 Claims, 6 Drawing Sheets

(56) References Cited

U.S. PATENT DOCUMENTS

| | | | | |
|---|---|---|---|---|
| 7,571,031 | B2 * | 8/2009 | Conner et al. | 701/16 |
| 7,633,430 | B1 * | 12/2009 | Wichgers et al. | 342/65 |
| 7,714,744 | B1 * | 5/2010 | Wichgers | 340/965 |
| 7,872,594 | B1 * | 1/2011 | Vesel | 340/970 |
| 8,234,020 | B1 * | 7/2012 | Wichgers et al. | 701/9 |
| 8,249,762 | B1 * | 8/2012 | Flotte et al. | 701/9 |
| 8,306,678 | B2 * | 11/2012 | Fleury et al. | 701/9 |
| 2002/0116097 | A1 * | 8/2002 | Block et al. | 701/9 |
| 2003/0156046 | A1 * | 8/2003 | Dwyer et al. | 340/973 |
| 2003/0195672 | A1 * | 10/2003 | He | 701/3 |
| 2003/0206120 | A1 * | 11/2003 | Ishihara et al. | 340/970 |
| 2004/0044445 | A1 * | 3/2004 | Burdon | 701/3 |
| 2004/0059473 | A1 * | 3/2004 | He | 701/4 |
| 2004/0083038 | A1 * | 4/2004 | He | 701/3 |
| 2004/0093131 | A1 * | 5/2004 | Block et al. | 701/9 |
| 2004/0111192 | A1 * | 6/2004 | Naimer et al. | 701/9 |
| 2004/0167684 | A1 * | 8/2004 | Ishihara et al. | 701/15 |
| 2006/0080008 | A1 * | 4/2006 | Ishihara et al. | 701/4 |
| 2006/0195235 | A1 * | 8/2006 | Ishihara et al. | 701/16 |
| 2007/0296612 | A1 * | 12/2007 | Ishihara et al. | 340/970 |
| 2008/0306639 | A1 * | 12/2008 | Fleury et al. | 701/7 |
| 2009/0082954 | A1 * | 3/2009 | Ridenour, II | 701/206 |
| 2010/0030400 | A1 * | 2/2010 | Komer et al. | 701/3 |
| 2010/0042273 | A1 * | 2/2010 | Meunier et al. | 701/9 |
| 2010/0145599 | A1 * | 6/2010 | Wise et al. | 701/120 |
| 2010/0286851 | A1 * | 11/2010 | Ishihara et al. | 701/9 |
| 2011/0029162 | A1 * | 2/2011 | Ishihara et al. | 701/9 |
| 2011/0276201 | A1 * | 11/2011 | Block | 701/9 |

* cited by examiner

TAWS WITH ALERT SUPPRESSION

CROSS-REFERENCE TO RELATED APPLICATIONS

This application claims benefit of priority of U.S. Provisional Patent Application Ser. No. 61/322,522, filed Apr. 9, 2010, entitled "METHOD AND APPARATUS FOR ENTRY OF LANDING ZONE INFORMATION FOR SUPPRESSION OF TAWS WARNINGS AND ALERTS", owned by the assignee of the present application and herein incorporated by reference in its entirety.

BACKGROUND

Terrain awareness systems, especially widely-used Terrain Awareness and Warning Systems (TAWS), are equipped with various detecting means in an endeavor to alert or warn the crew or the pilot of an aircraft of, among many other situations, an impending terrain collision situation during the flight and/or during the landing operation of the aircraft. However, as it turns out, not all alerts are genuine. False alerts sometimes occur for a variety of reasons. As the workload of the crew increases, or during critical times such as take-off and landing, these false alerts become more annoying.

Therefore, in light of the above discussion, there is a need in the art for a terrain awareness warning system that does not suffer from the above disadvantages.

SUMMARY

As noted above, not all alerts are cause for alarm. For example, alerts which occur during the landing operation of the aircraft are often nuisance alerts, and these occur because of the lack of recognition of the current landing zone of the aircraft as a "safe" landing zone by the TAWS. More particularly, the TAWS is supported by a TAWS database configured to store a plurality of landing zones that are recognized by the manufacturers of the TAWS, a relevant aviation authority, or the like. The TAWS further includes a GPS device for detecting the current location of the aircraft. If a potential LZ is not in the database, the TAWS, based on an algorithm, will issue a potential-terrain-collision alert upon determining that the current landing zone is not a recognized landing zone even when the current landing zone is suitable for performing a landing operation. This occurrence is all the more true for Vertical Take-Off and Landing (VTOL) aircraft such as helicopters, as the same often land at non-airport locations.

However, many TAWS devices have provisions for allowing the crew of the aircraft to temporarily deactivate the unnecessary alerts. Such arrangements require the crew or the pilot of the aircraft to reset the deactivation button once the landing operation is performed or when the aircraft is ready for another flight. Forgetting to do so on the part of the pilot or the crew could lead to the inadvertent suppression of necessary genuine alerts, which could lead to a potential Controlled Flight Into Terrain (CFIT) accident.

The present systems and methods relate to TAWS employed in aircraft, and more particularly to a TAWS with provisions for a client-side user to interact therewith so as to allow the filtering out or suppression of false alerts that are issued during the landing operation of the aircraft, e.g., at legitmate landing zones.

In more detail, the present systems and methods teach an improved aircraft TAWS including a database that is in communication with an interface. The interface may receive flight plan information directly from a user or the user may enter flight plan information into a flight management computer or navigation receiver and have the TAWS communicate with the flight management computer or navigation receiver to accomplish the goals described here. The database is configured to store, among other things, waypoints, where each of the waypoints represents a geographical area that may include a landing zone associated with a unique landing zone identifier, e.g., "LZ" followed by a three digit number. The landing zone may be a helipad, an airport or airfield, a defined landing zone, or any other suitable location. The flight plan details of the aircraft, which includes at least one waypoint, are generally entered into a flight management computer, but in some cases one or more waypoints may be entered into the TAWS itself via a suitable interface. The flight plan details, including waypoints and landing zones, can be entered before or during the flight. Once a waypoint is entered, the TAWS is configured to determine whether or not the waypoint is associated with a landing-zone-identifier, e.g., by polling the flight management computer for waypoint information. If so, potential-terrain-collision alerts are suppressed during the landing operation of the aircraft performed at the landing zone represented by the landing-zone-identifier.

In one aspect, the invention is directed towards an aircraft terrain awareness warning system, including an interface for entering flight plan details of an aircraft including at least one waypoint wherein the terrain awareness system is configured such that alerts are suppressed in the aircraft during a landing operation thereof performed at a landing zone associated with the at least one waypoint.

Implementations of the invention may include one or more of the following. The terrain awareness warning system may further include a database including waypoints, each of the waypoints representing a geographical area, at least one of the waypoints including a landing zone associated with a unique landing-zone-identifier. The alerts may include potential-terrain-collision alerts. The system may be configured to parse landing zone identifiers to determine if a waypoint includes a landing zone. The interface may include a user interface, the user interface including a plurality of data-entry fields for receiving waypoints, or the may be an interface to a flight management computer. The aircraft may be a Vertical Take-off and Landing (VTOL) aircraft.

In another aspect, the invention is directed towards a method for performing terrain awareness with reduced false alerts, including: (a) providing a first interface for enabling the crew of an aircraft to enter flight plan details of an aircraft including at least one waypoint, the flight plan details communicated to a terrain awareness warning system via a second interface; and (b) configuring the terrain awareness warning system such that alerts are suppressed during a landing operation of the aircraft performed at a landing zone located in a geographical area associated with the at least one waypoint.

Implementations of the invention may include one or more of the following. The system may include a database having waypoints, each of the waypoints representing a geographical area, at least one of the waypoints including a landing zone associated with a unique landing-zone-identifier. The alerts may include potential-terrain-collision alerts. The first and second interfaces may provide interfaces to a flight management computer or navigation receiver, and flight plan details may be entered on the flight management computer or navigation receiver and communicated to a TAWS. The interface may include a plurality of data-entry fields within which the flight plan details are received. The waypoint may be a terrestrial waypoint such as a landing zone.

In a further aspect, the invention is directed towards a computer-readable medium, including instructions for causing a computing device to perform the above method.

In yet another aspect, the invention is directed towards an aircraft terrain awareness warning system including: (a) a database module including waypoints, each of the waypoints representing a geographic area, at least one waypoint including a landing zone associated with a unique landing-zone identifier; and (b) an interface module for receiving flight plan details of an aircraft including at least one waypoint, the user interface in communication with the database, wherein the terrain awareness warning system is configured such that potential-terrain-collision alerts are suppressed in the aircraft during a landing operation at a landing zone represented by a landing-zone-identifier.

Implementations of the invention may include one or more of the following. The alerts may include potential-terrain-collision alerts. The waypoint may include a terrestrial waypoint. The interface may include a plurality of data-entry fields for receiving flight plan details therewithin. The interface module may receive data from a flight management computer or navigation receiver.

The advantages of the embodiments herein will become readily apparent from the following detailed description taken in conjunction with the accompanying drawings.

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that logical, mechanical and other changes may be made without departing from the scope of the embodiments. The following detailed description is therefore not to be taken in a limiting sense.

Implementations of the present invention are in the context of a TAWS employed in an aircraft for providing, among other things, visual and aural alerts or warnings to the crew or the pilot of the aircraft when the aircraft is within an unsafe proximity to terrain. The system described is advantageous because of its ability to eliminate false, nuisance alerts that are issued during certain landing operations of the aircraft. The system is applicable for any type of aircraft; however, Vertical Take-Off and Landing (VOTL) aircraft, such as helicopters, may particularly benefit from implementations of the system as the same often land at non-airport locations at which the false alerts are commonly triggered.

Figure 1:
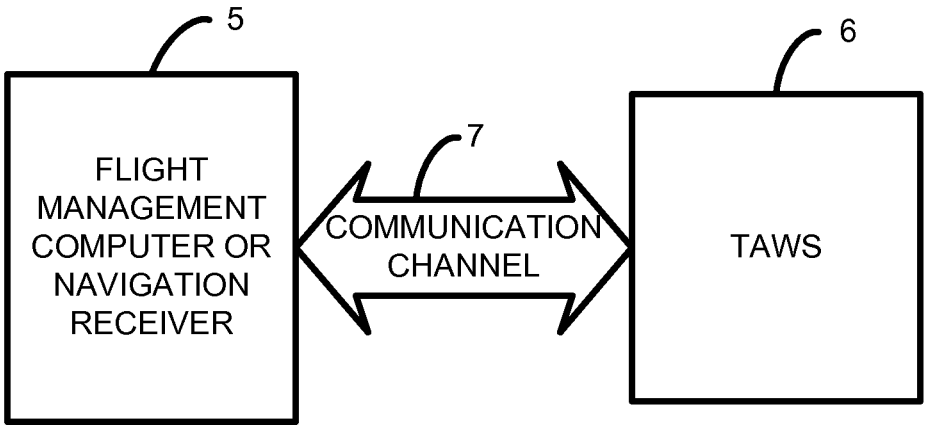
FIG. 1 is a schematic illustration of one implementation of a terrain awareness warning system according to an embodiment of the present invention.

Referring to FIG. 1, a TAWS systems 6 is illustrated coupled to a flight management computer or navigation receiver 5 through a communication channel 7. In many cases, a pilot, navigator, or another user will enter flight plan information into the flight management computer 5, and the flight plan information may include waypoints, landing zones, or any other useful flight information. The same may be loaded from a database of common routes. This information may then be transmitted to the TAWS 6, or the TAWS 6 may poll the flight management computer 5 for such information. The determination of which landing zones will cause alert suppression, as well as how the suppression occurs, may occur in the flight management computer 5 or in the TAWS 6. In some cases, the two will work together to accomplish this goal. Numerous variations will be seen to one of ordinary skill in the art. For example, as noted, waypoints may be entered into a flight management computer and detected through a communication channel by the TAWS. In other cases, certain waypoint may be entered into the TAWS itself. In some cases, waypoints having certain types of identifiers may be flagged by the flight management computer as potential or definite landing zones. The flight management computer and TAWS may distribute the functionality required to perform implementations of the invention in any way, amongst the two components or including other avionics components as well.

Figure 2:
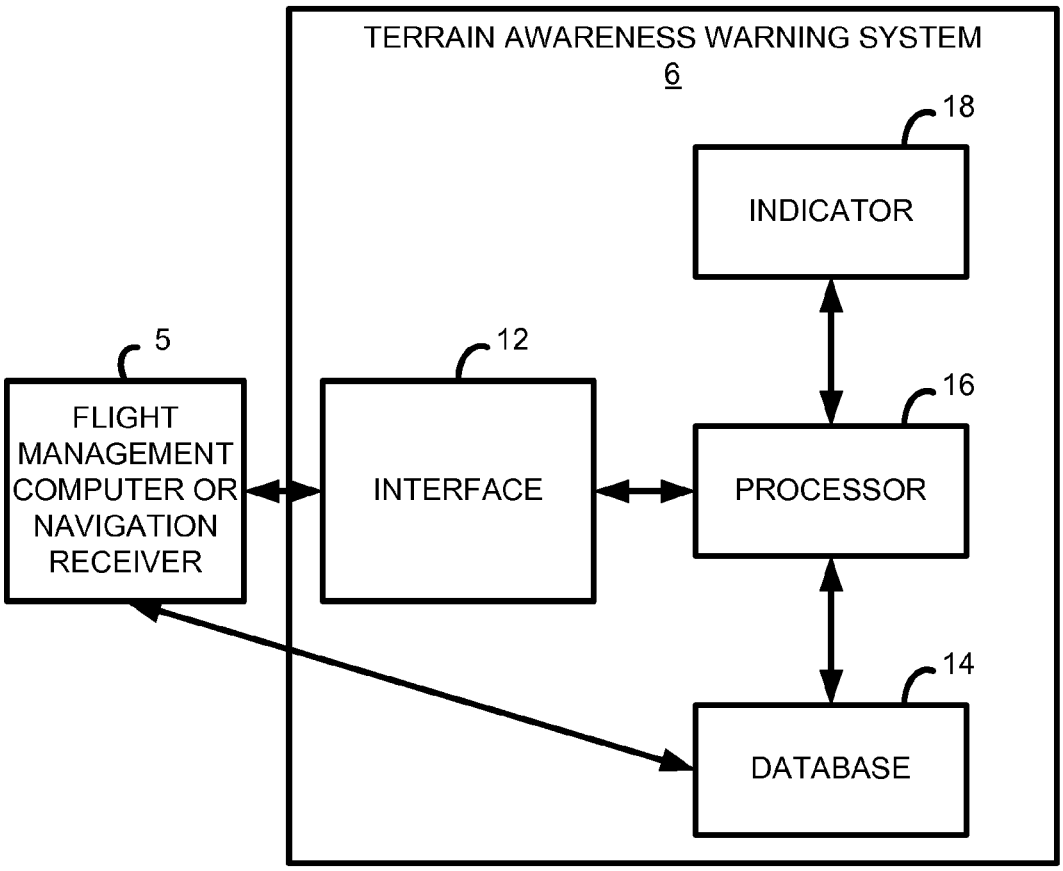
FIG. 2 is a schematic illustration of a terrain awareness warning system according to another embodiment of the present invention.

Referring to FIG. 2, the system 10 may include, a client-side user interface 12, a database 14, and an indicator 18, which exchange data through a processor 16. The user interface 12 enables the flight management computer 5 or the crew of the aircraft to interact with the TAWS 6 as enabled by the processor 16. More particularly, the user interface 12 includes a plurality of data-entry fields for receiving flight plan details of the aircraft, which includes at least one terrestrial waypoint that represents a geographical area or location. The flight plan details may also include estimated time en route, alternate airports in case of bad weather, type of flight, pilot's name, number of people onboard, etc. The flight plan details can be entered before or during the flight. As noted, commonly the flight management computer 5 may be employed to access the system 6 in which case the flight plan details are entered on a device and from a location other than from the system 6 itself.

Still referring to FIG. 2, the system 10 is an extension of a GPS navigator/receiver and therefore the database 14 includes waypoints representing geographic areas. Each of the waypoints represents a geographical area, and may include a landing zone that is associated with a unique-landing-zone identifier. The landing zone could be a helipad, an airport, or any other type of location or airfield. The database 14 is adapted to store the flight plan details in a retrievable manner. The indicator 16 could be a visual indicator such as an LCD monitor, or an aural indicator such as a speaker, or both, for effectively providing alerts to the pilot and crew of the aircraft.

Figure 3:
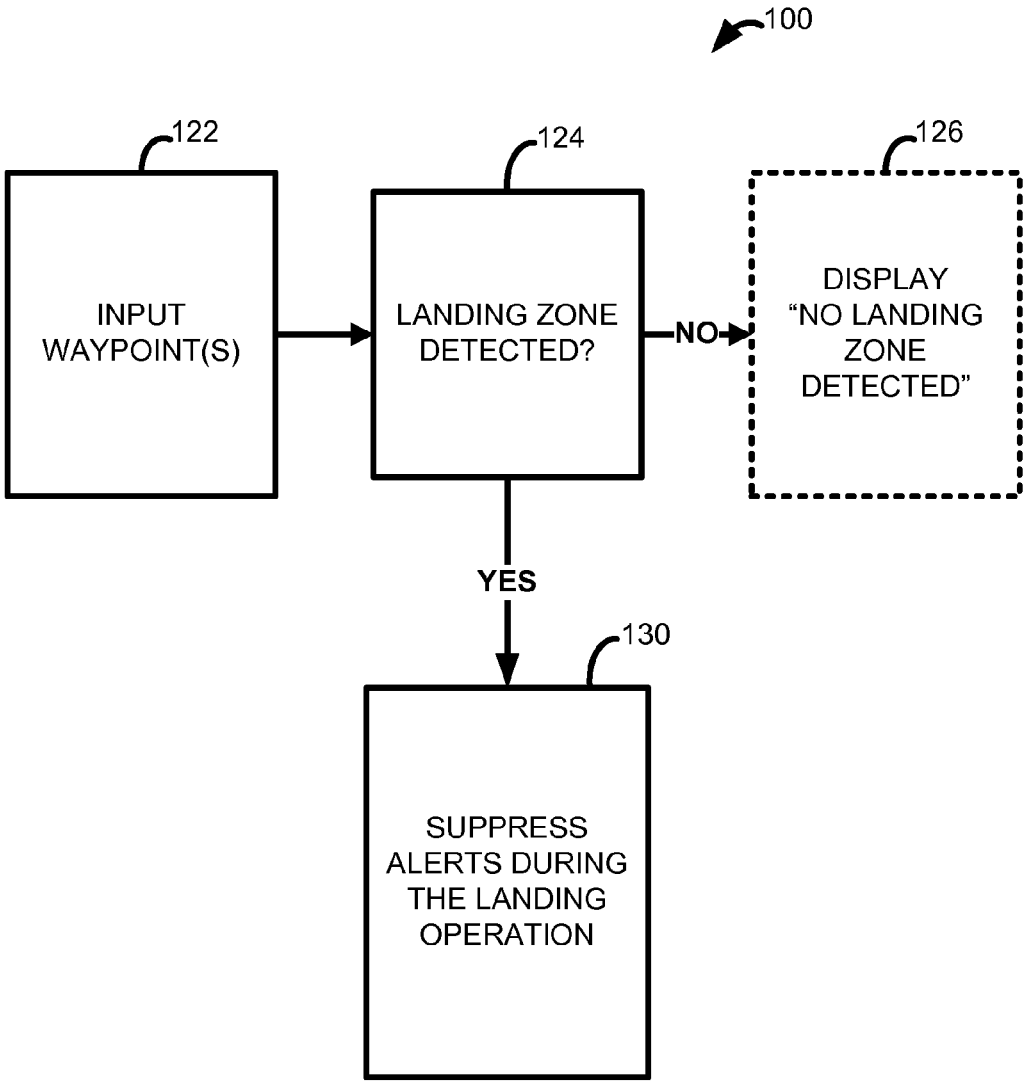
FIG. 3 is a flowchart depicting the elimination of false alerts according to an embodiment of the present invention.

Referring to FIG. 3, the operation of the terrain awareness system is illustrated by flowchart 100 and is initiated with the input of the flight plan details into their respective data-entry fields using the interface (step 122). This information is typically entered on the flight management computer or on a GPS receiver/navigator as noted in FIG. 1, or the same may be entered in some cases on a TAWS. For example, the TAWS may provide the capability to enter one or more locations at which to suppress alerts. Once the details are in place, the processor parses the details to detect a waypoint or waypoints. Once detected, the processor determines whether or not a waypoint is associated with a landing-zone-identifier (step 124). In particular, the system and method may search for particular types of entries, e.g., searches or senses for particular combinations of letters in the entries of flightplan waypoints. One particular pattern of text it may search for is of the form "LZ###", where "###" represents a three-digit number enumerating a given landing zone ("LZ"). The system or method may check that the chosen textual pattern is not reserved for or in conflict with another use. If none are found, an optional step may be that the processor, through the user interface, may convey that no landing zone is identified within the entered waypoints or within a geographical area represented by the entered waypoints (step 126). However, if one or more waypoints are associated with landing-zone-identifiers, the processor may cause the suppression of alerts, such as potential-terrain-collision alerts, during the landing operation of the aircraft performed at the associated landing zones (step 130).

Example

1. A pilot and aircraft may use, for example, a Garmin® 430 GPS navigator.
2. The pilot activates a flightplan menu, which brings up a list or catalog of airports. For example, US airports generally start with the letter "K".
3. The pilot may then enter several waypoints in this fashion. Typically these waypoints are predetermined navigational points, known as "NavAids".
4. To enter a landing zone, the pilot provides an identifier not in the catalog, in this example starting with the letters "LZ".
5. (In other cases a known route may be loaded.)
6. The TAWS receives the navigator waypoints through the communications channel. If waypoints are found with the prefix LZ, then these waypoints are treated as landing zones by the TAWS software, allowing for alert suppression during a landing operation at such locations according to its suppression algorithm.

Figure 4:
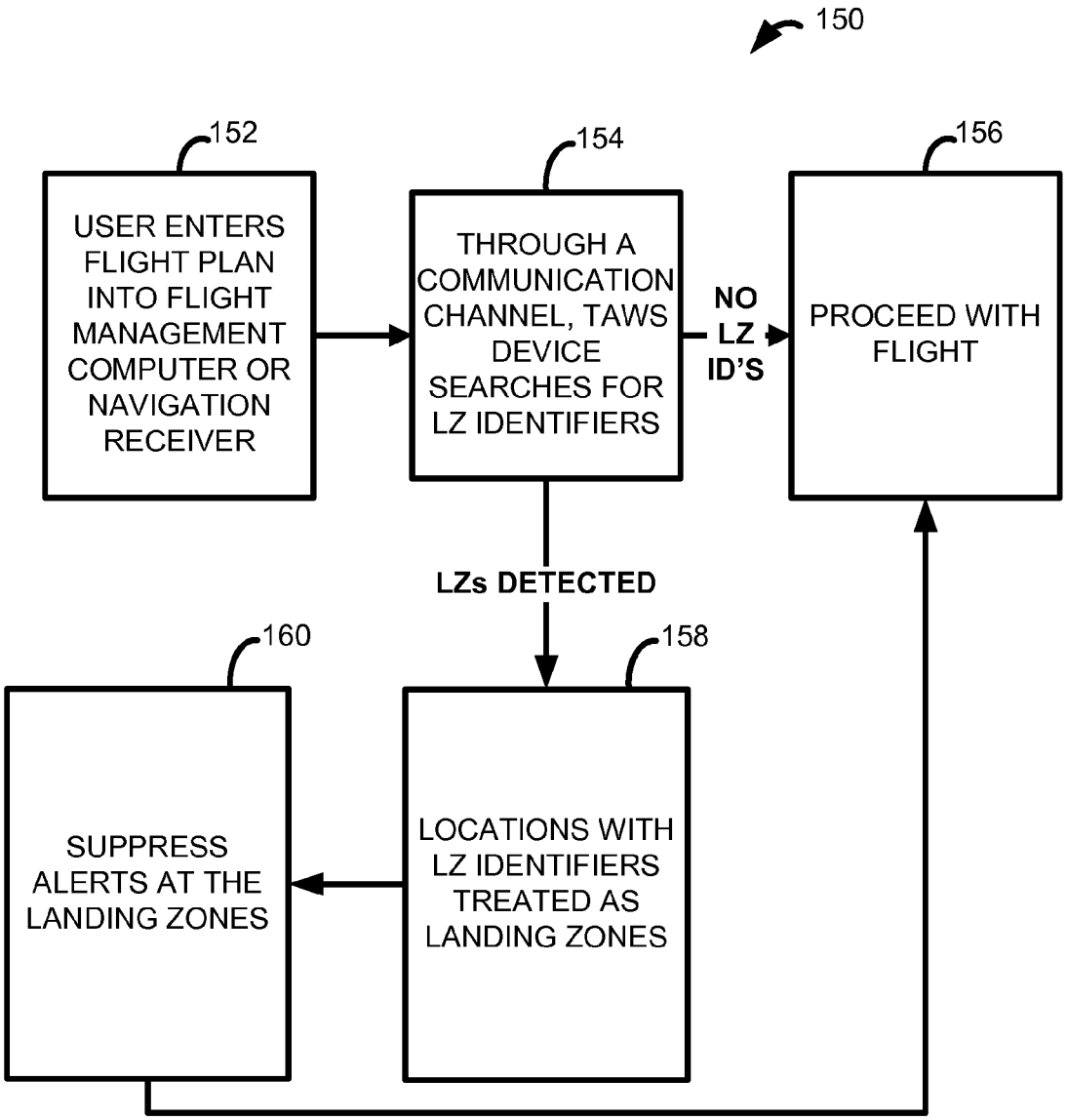
FIG. 4 is a flowchart depicting the elimination of false alerts according to another embodiment of the present invention.

Referring to FIG. 4, a flowchart 150 is shown illustrating a method according to another implementation of the invention. In the flowchart 150, a first step is that a user, e.g., the pilot or navigator, enters a flightplan, including waypoints, into a flight management computer, navigation receiver, or other such device (step 152). Through a communications channel, a TAWS then samples or otherwise detects landing zone identifiers in the flight management computer (step 154). If any are detected, those locations having landing zone identifiers are treated as landing zones (step 158) and alerts at those locations are suppressed (step 160) while the flight proceeds. If no landing zone identifiers are detected, then the method continues and no additional waypoints (landing zones) have alerts suspended (step 156).

Figure 5:
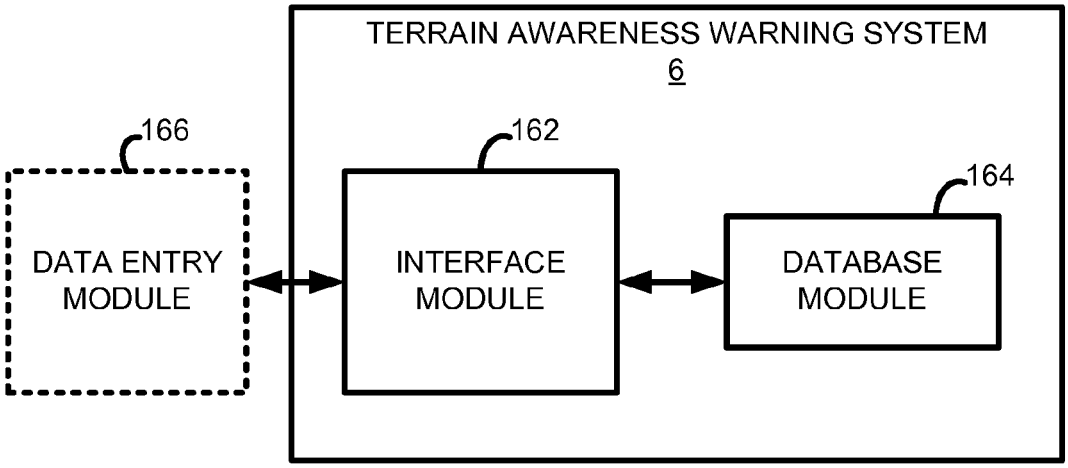
FIG. 5 is a schematic illustration of a terrain awareness warning system according to another embodiment of the present invention.

FIG. 5 illustrates a modular depiction of an exemplary TAWS 6 that may constitute the system and perform the described method. The system 6 includes an interface module 162, which may provide a suitable interface between the system 6 and a flight management computer or navigation receiver. The interface module 162 may further include a user interface for entry of waypoints directly to the TAWS. The modules by which a flight management computer, navigation receiver, or user may enter data are comprehensively illustrated by data entry module 166. The TAWS 6 may also include a database module 164, which may store waypoints and other flight plan information, including stored routes, prior waypoints and landing zones, data downloaded from servers, data included by the manufacturer, or the like.

Figure 6:
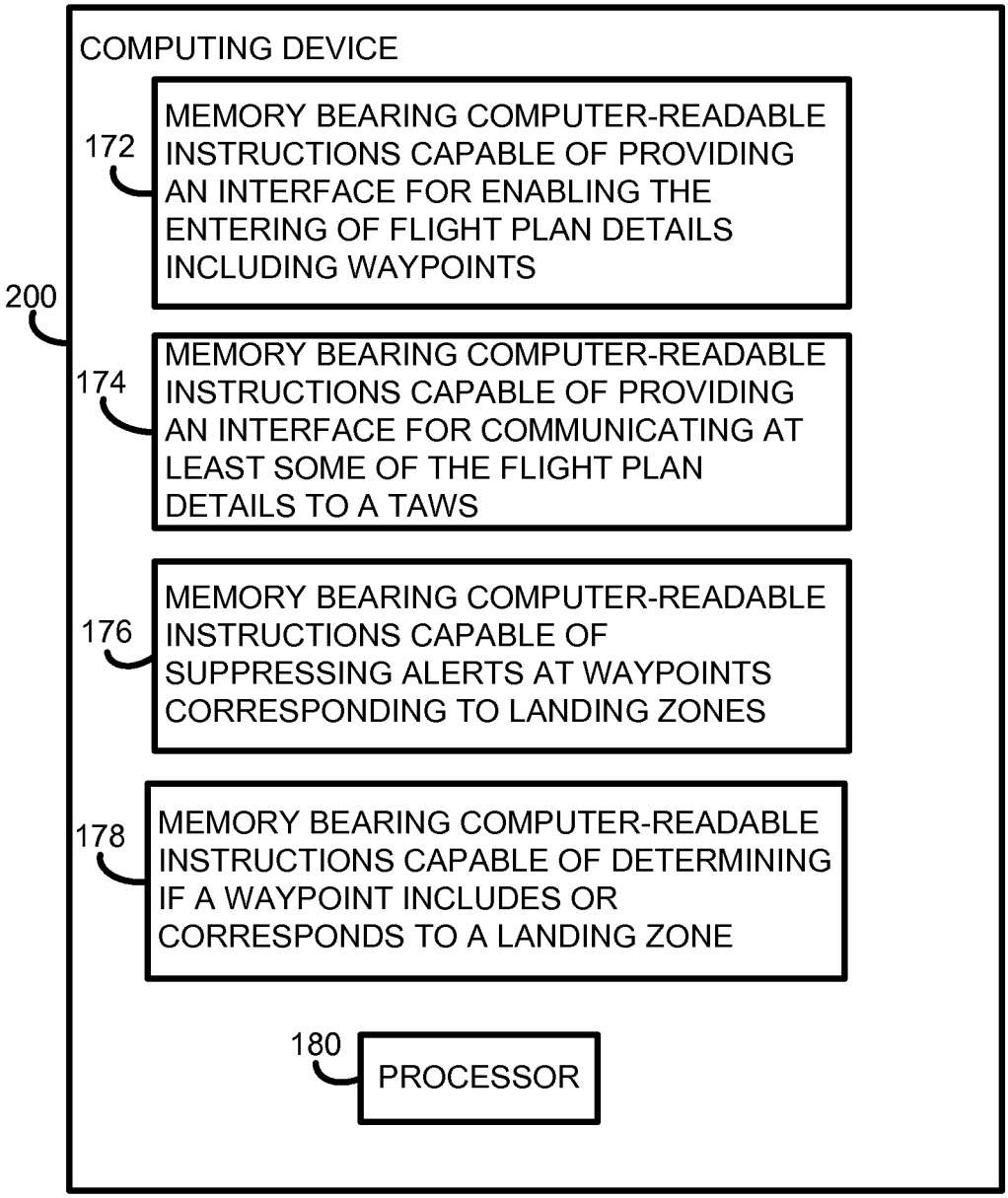
FIG. 6 is a schematic illustration of a terrain awareness warning system according to another embodiment of the present invention.

FIG. 6 illustrates another depiction of an exemplary computing device 200 that may constitute the system and perform the described method. The device 200 includes a processor 180 and a memory 172 bearing computer-readable instructions capable of providing an interface for enabling the entering of flight plan details, e.g., waypoints, which may including landing zones. The device 200 further includes memory 174 bearing computer-readable instructions capable of providing an interface for communicating at least some of the flight plan details to a device that can warn a pilot of proximity to terrain, such as a TAWS. The device 200 further includes memory 176 bearing computer-readable instructions capable of suppressing alerts at waypoints that corresponding to landing zones, e.g., those that have landing-zone identifiers. The device 200 further includes memory 178 bearing computer-readable instructions capable of determining if an entered waypoint corresponds to a landing zone. Other memories will also be understood to be possible for use in performing other steps noted in this specification.

As described above, systems and methods are provided to suppress alerts at known the landing zones. Any such landing zone found among the flightplan waypoints may be utilized by a TAWS as a known landing point. The system can then apply alert suppression techniques to suppress alerts during the landing operation. In this way, the desired effect is achieved.

The system and method may be fully implemented in any number of computing devices, and these computing devices may be embodied as the flight management computer, navigation receiver, TAWS system, or the like. Typically, instructions are laid out on non-transitory computer readable media, and these instructions are sufficient to allow a processor in the computing device to implement the methods of the invention. The computer readable medium may be a hard drive or solid state storage device having instructions that, when run, are loaded into random access memory. Inputs to the application, e.g., from a plurality of users or from any one user, may be via any number of appropriate computer input devices. For example, users may employ a keyboard, mouse, touchscreen, joystick, trackpad, other pointing device, or any other such computer input device to input data relevant to the calculations. Data may also be input by way of an inserted memory chip, hard drive, flash drives, flash memory, optical media, magnetic media, or any other type of file—storing medium. The outputs may be delivered to a user, e.g., a pilot or navigator, by way of a video graphics card or integrated graphics chipset coupled to a display that may be seen by the same. Alternatively, a printer may be employed to output hard copies of the results. Given this teaching, any number of other tangible outputs will also be understood to be contemplated by the invention. For example, outputs may be stored on a memory chip, hard drive, flash drives, flash memory, optical media, magnetic media, or any other type of output. It should also be noted that the invention may be implemented on any number of different types of computing devices, e.g., personal computers, laptop computers, notebook computers, net book computers, handheld computers, personal digital assistants, mobile phones, smart phones, tablet computers, and also on devices specifically designed for these purpose. In one implementation, a user of a smart phone or Wi-Fi—connected device downloads a copy of the application to their device from a server using a wireless Internet connection. The application may download over the mobile connection, or over the WiFi or other wireless network connection. The application may then be run by the user. Such a networked system may provide a suitable computing environment for an implementation in which a plurality of users provide separate inputs to the system and method.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. For example, the flight management computer and TAWS may distribute functionality in any number of ways. The system may be implemented in avionics systems besides TAWS devices. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

The invention claimed is:

1. An aircraft terrain awareness warning system, comprising:

a. a database comprising recognized waypoints and user-entered waypoints, each of the recognized user-entered waypoints representing a geographical area, at least one of the recognized waypoints including a recognized landing zone associated with a unique landing-zone identifier at least one of the user-entered waypoints not included in the recognized waypoints and including a recognized landing zone associated with a unique landing-zone identifier, and b. an interface for entering flight plan details of an aircraft including at least one user-entered waypoint that is not a recognized waypoint, the at least one user-entered waypoint having an identifier including a textual code that indicates the nature of the waypoint, wherein the terrain awareness system is configured to parse the user-entered waypoints for identifiers to determine if one or more entered waypoints includes an identifier indicating a landing zone, such that alerts are suppressed in the terrain awareness system during a landing operation thereof performed at the entered waypoint having an identifier associated with a landing zone.

2. The aircraft terrain awareness warning system of claim 1, wherein the interface includes a user interface, the user interface including at least one data entry field for a user to enter a waypoint, landing zone or landing zone identifier.

3. The aircraft terrain awareness warning system of claim 1, wherein the alerts comprise potential-terrain-collision alerts.

4. The aircraft terrain awareness warning system of claim 1, wherein the aircraft comprises a Vertical Take-off and Landing (VTOL) aircraft.

5. The aircraft terrain awareness warning system of claim 1, wherein the interface includes a user interface, the user interface including a plurality of data-entry fields for receiving waypoints.

6. The aircraft terrain awareness warning system of claim 5, wherein the interface is an interface to a flight management computer.

7. A method for performing terrain awareness with reduced false alerts, comprising:

(a) providing a first interface for enabling the crew of an aircraft to enter flight plan details of an aircraft including at least one user-entered waypoint that is not a recognized waypoint, the flight plan details communicated to a terrain awareness warning system via a second interface, wherein the terrain awareness warning system includes a database having a plurality of recognized waypoints, each of the recognized waypoints representing a geographical area, at least one of the waypoints including a landing zone associated with a unique landing-zone-identifier; and (b) configuring the terrain awareness warning system to determine if user-entered waypoints entered on the interface that are not recognized waypoints have an identifier associated with a landing zone the identifier including a textual code that indicates the nature of the waypoint, and configuring the terrain awareness warning system such that alerts are suppressed during a landing operation of the aircraft performed at a user-entered waypoint entered on the interface that is not a recognized waypoint but which has an identifier associated with a landing zone.

8. The method of claim 7, further comprising providing a user interface, the user interface including at least one data entry field for a user to enter a landing zone or waypoint or landing zone identifier.

9. The method of claim 7, wherein the alerts comprise potential-terrain-collision alerts.

10. The method of claim 7, wherein the interface is coupled to a flight management computer or navigation receiver, and wherein flight plan details are entered on the flight management computer or navigation receiver and communicated to the interface.

11. The method of claim 7, wherein the interface includes a plurality of data-entry fields within which the flight plan details are received.

12. The method of claim 7, wherein the waypoint is a terrestrial waypoint.

13. A non-transitory computer-readable medium, comprising instructions for causing a computing device to perform the method of claim 7.

14. An aircraft terrain awareness warning system comprising:

(a) a database module comprising recognized waypoints, each of the recognized waypoints representing a geographic area, at least one recognized waypoint including a landing zone associated with a unique landing-zone identifier; and (b) an interface module for receiving flight plan details of an aircraft including at least one user-entered waypoint that is not a recognized waypoint, the received waypoint having a unique identifier including a textual code that indicates the nature of the waypoint, the user interface in communication with the TAWS database, wherein the terrain awareness warning system is configured to determine if the at least one waypoint that is not a recognized waypoint has an identifier indicating a landing zone, such that potential-terrain-collision alerts are suppressed in the aircraft during a landing operation at the user-entered waypoint that is not a recognized waypoint but which has an identifier indicating a landing zone.

15. The system of claim 14, wherein the alerts comprise potential-terrain-collision alerts.

16. The system of claim 14, wherein the waypoint comprises a terrestrial waypoint.

17. The system of claim 14, wherein the interface includes a plurality of data-entry fields for receiving flight plan details therewithin.

18. The system of claim 14, wherein the interface module receives data from a flight management computer or navigation receiver.

19. The aircraft terrain awareness warning system of claim 14, wherein the interface module is configured to provide a user interface, the user interface including at least one data entry field for a user to enter a waypoint, landing zone or landing zone identifier.

20. A method for performing terrain awareness with reduced false alerts, comprising:

(a) providing an interface for enabling the crew of an aircraft to enter flight plan details of an aircraft including at least one user-entered waypoint having an identifier including a textual code that indicates the nature of the waypoint;

(b) providing a TAWS system including a database of recognized waypoints;

(c) upon receipt of a user-entered waypoint from the interface, determining if the user-entered waypoint is a recognized waypoint;

(d) if the waypoint is not a recognized waypoint, determining if the identifier indicates that the received user-entered waypoint is a landing zone; and (e) if the received user-entered waypoint is a landing zone, suppressing alerts during a landing operation of the aircraft at the received user-entered waypoint.

21. A non-transitory computer-readable medium, comprising instructions for causing a computing device to perform the method of claim 20.

* * * * *

UNITED STATES PATENT AND TRADEMARK OFFICE

CERTIFICATE OF CORRECTION

PATENT NO. : 8,890,718 B2
APPLICATION NO. : 13/083115
DATED : November 18, 2014
INVENTOR(S) : Block It is certified that error appears in the above-identified patent and that said Letters Patent is hereby corrected as shown below:

In the claims
Claim 1, col. 7, line 26, after "recognized" and before "user-entered", please add the word "and" so that it reads, -- recognized and user-entered --

Signed and Sealed this
Twenty-third Day of February, 2016

Michelle K. Lee

Michelle K. Lee
*Director of the United States Patent and Trademark Office*